US009896168B1

(12) United States Patent
Lindbergh

(10) Patent No.: US 9,896,168 B1
(45) Date of Patent: Feb. 20, 2018

(54) SWING RANGE ADJUSTABLE FIN ASSEMBLY

(71) Applicant: Paul Lindbergh, Kea'au, HI (US)

(72) Inventor: Paul Lindbergh, Kea'au, HI (US)

(73) Assignee: WAVETECH FINS, INC., Renton, WA (US)

( * ) Notice: Subject to any disclaimer, the term of this patent is extended or adjusted under 35 U.S.C. 154(b) by 0 days.

(21) Appl. No.: 15/612,110

(22) Filed: Jun. 2, 2017

(51) Int. Cl.
*B63B 35/00* (2006.01)
*B63B 35/79* (2006.01)

(52) U.S. Cl.
CPC ..... *B63B 35/7926* (2013.01); *B63B 35/793* (2013.01)

(58) Field of Classification Search
CPC ..... B63B 35/7926; B63B 35/793
See application file for complete search history.

(56) References Cited

U.S. PATENT DOCUMENTS 3,585,663 A 6/1971 Johnson
4,077,077 A * 3/1978 Harper ..... B63B 35/81 114/140
4,493,665 A * 1/1985 Liddle ..... B63B 35/7926 114/127
5,328,397 A * 7/1994 Whitty ..... B63B 35/7926 441/74
6,386,933 B1 5/2002 Rewald et al.
9,139,265 B2 * 9/2015 Peberdy ..... B63B 35/793
9,266,588 B2 2/2016 Shlinger et al.
9,751,600 B2 * 9/2017 Elliott ..... B63B 35/793
2004/0248482 A1 12/2004 Larkin
2010/0311294 A1 * 12/2010 Foulke ..... B63B 35/793 441/79

FOREIGN PATENT DOCUMENTS

WO 03095301 A1 11/2003
WO 2015095910 A1 7/2015
WO 2017045011 3/2017

* cited by examiner

*Primary Examiner* — Stephen P Avila
(74) *Attorney, Agent, or Firm* — Timothy E. Siegel Patent Law, PLLC; Timothy E. Siegel

(57) ABSTRACT

A swing-range adjustable fin assembly that fits into a standard finbox of a surfboard. A set of fin-stop pin guideways, each having a set of pin fixation locations, and a pin loading port, permit a user to load a pin, move it and fix it into a position where it will constrain the fin swing range. Also disclosed is a surfboard comprising such a swing-range adjustable fin assembly.

21 Claims, 4 Drawing Sheets

SWING RANGE ADJUSTABLE FIN ASSEMBLY

BACKGROUND

The first surfboards were simple, substantially flat boards used for riding waves. Modern surfboards typically include one or more fins attached to the underside of the board which allow the surfer greater control over speed and trajectory. The size, shape, and angle of the fin or fins are significant factors in how the surfboard handles under various conditions. It is common for surfboards to be constructed with a standard finbox that allows the attachment and removal of fins having corresponding standard connectors. This allows the surfer to switch between fins having various properties depending on the conditions and the surfer's preferences. Among the properties that can be varied by fin selection is attack angle, which is the angle of the fin relative to the longitudinal axis of the surfboard. In some situations, performance could be improved by a fin capable of swinging through a range of attack angles during the course of a single ride. A fin that swings freely through all possible attack angles, however, would make the surfboard difficult to control and could be dangerous to the surfer. A surfboard fin capable of swinging through a variety of attack angles and yet having the attack angle sufficiently constricted to be useful does not appear to be provided by the prior art.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The teachings herein are directed to a surfboard fin assembly comprising a blade that engages a standard finbox, a base attached to the blade and having two pin guideways, and a rod extending down from the blade and connected to a fin which rotates about the rod. A fin stop pin is located in each pin guideway and projects out of the guideway into the path of rotation of the fin, blocking the fin from moving beyond the range of rotation set by the pin.

In one embodiment, the rod rotates with respect to the blade. In another embodiment, the fin rotates with respect to the rod.

In one embodiment, the pin guideways are channels in the base, to a void space defined in the base. In a further embodiment, the channels include a set of pin-fixation positions that hold a fin-stop pin at a specific location within the channel.

In one embodiment, the channels have a wide top and a narrow bottom, while the fin-stop pins have a wide base and a post. The base of a fin-stop pin fits into the wide top of the channel but cannot pass through the narrow bottom of the channel, such that the fin-stop pin is trapped within the channel but still able to slide along the channel. The post of the fin-stop pin projects thought the narrow bottom of the channel and into the path of rotation of the fin, blocking the fin from rotating past the location of the fin-stop pin.

The teachings herein are additionally directed to a surfboard comprising such a fin assembly. The surfboard defines a board plane that bisects the board between top and bottom along its greatest length and a fin plane that bisects the board along its length and is perpendicular to the board plane.

In one embodiment, the surfboard includes a fin port and the fin assembly includes a mating portion that fits into the fin port and secures the fin. A standard fin port is one form of a fin port. A blade is one form of a mating portion on a fin assembly that fits into a standard fin port.

In one embodiment, the fin-stop pins are independently adjustable. Adjustment of the fin-stop pins allows the fin to rotate up to 22.5 degrees relative to the fin plane.

In a further embodiment, the rod is tilted rearwardly relative to a line perpendicular to the board plane.

In addition to the exemplary aspects and embodiments described above, further aspects and embodiments will become apparent by reference to the drawings and by study of the following detailed descriptions.

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Definition: As used in this application the term "surfboard" encompasses stand up paddle boards and other water recreation boards.

Figure 1:
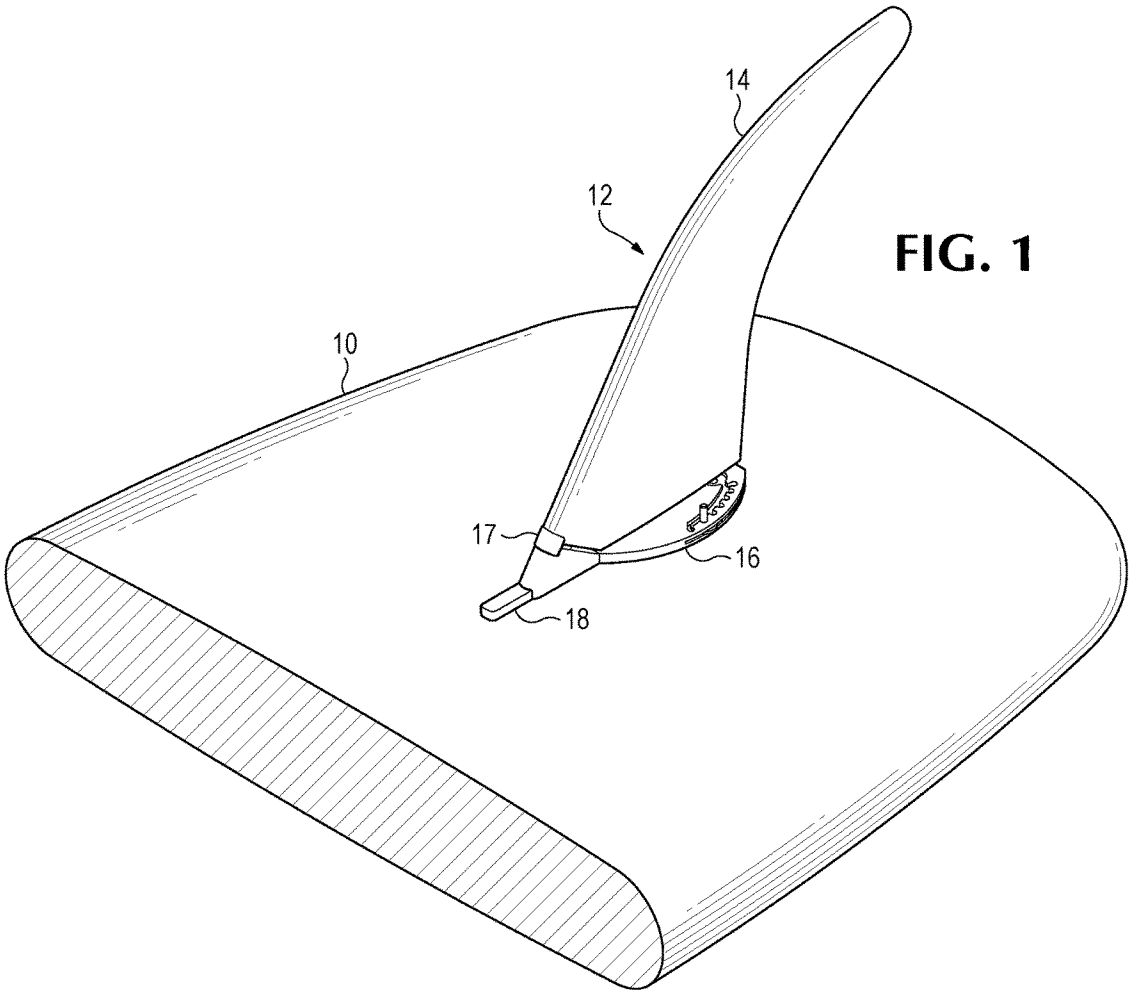
FIG. 1 is a front-side-bottom isometric view of a surfboard with a fin assembly according to one preferred embodiment.
Figure 2:
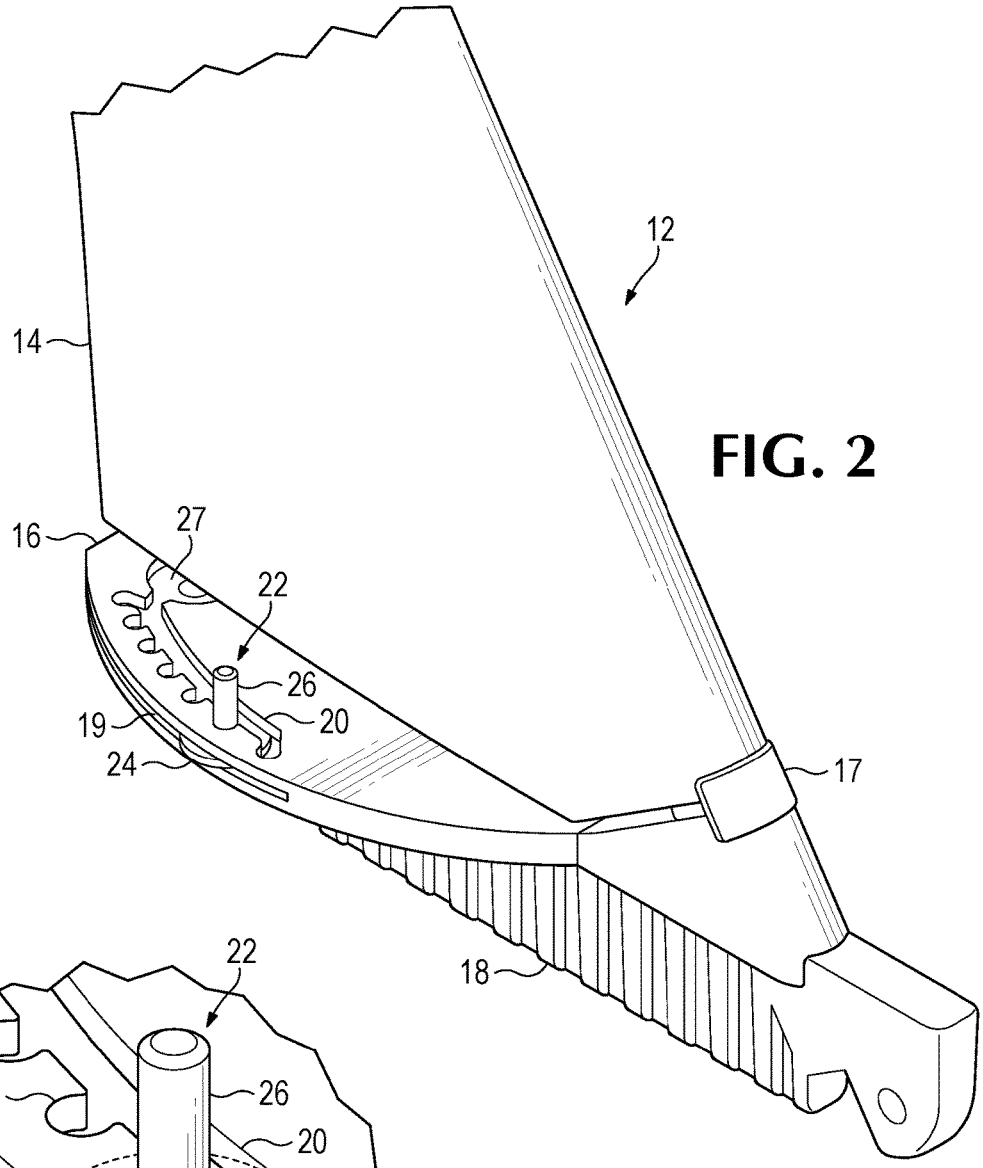
FIG. 2 is a detail view of the fin assembly of FIG. 1, showing a fin, a blade, a fin centering element and a pin guideway with a fin-stop pin engaged in one pin-fixation position.

Referring to FIG. 1, in one embodiment a surfboard 10 is provided, having a fin assembly 12. The fin assembly 12 includes a fin 14, a base 16, a fin centering element 17 and a blade 18. The fin assembly 12 is removably attached to the bottom of the surfboard 10 such that the fin assembly is underwater when the surfboard is in use. Referring now to FIG. 2, in one embodiment the fin assembly base 16 is joined at a right angle to the blade 18, which is shaped to mate with a standard surfboard finbox. A surfboard finbox is typically an insert that is permanently secured within a slot on the bottom of a surfboard and has means for removably securing a fin to the insert. As it is used in this application, a standard finbox is a finbox as described in US Patent Application Publication 2007/0202760.

The base 16 includes two void spaces 19, each formed by an inward cut through a side surface of base 16, in a dimension generally coincident with the plane of the base 16. A pin guideway 20, is formed by a channel cut into the base to the void space 19. Other forms of pin guideway may also be used.

Figure 3:
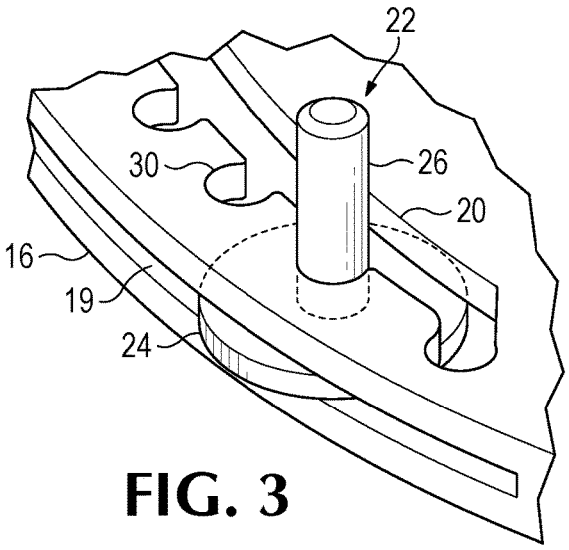
FIG. 3 is a detail view of the fin assembly of FIG. 1, showing a pin guideway with a fin-stop pin engaged in one pin-fixation position.
Figure 7:
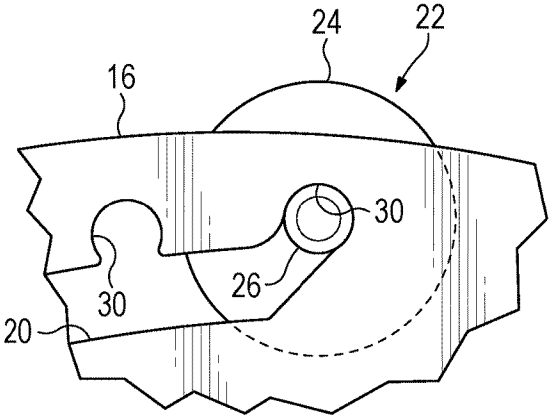
FIG. 7 is a detail view of a pin guideway and fin-stop pin of FIG. 1, showing the fin-stop pin in the last pin-fixation position.

As shown in FIGS. 3 and 7, the fin-stop pin 22 has a wide base 24 and an attached post 26. The pin guideway 20 has a wide top and a narrow bottom, such that the fin-stop pin base 24 fits into the wide top of the pin guideway but cannot pass through the narrow bottom of the pin guideway. The fin-stop pin post 26 fits through the narrow bottom of the pin guideway, protruding into the path of rotation of the fin. At one position along the pin guideway 20, the narrow bottom of the pin guideway widens out to form a pin port 27 that allows the passage of the fin-stop base 24, thereby allowing the fin-stop pin to be inserted or removed from the pin guideway 20. In one embodiment, the pin port 27 is contiguous with both pin guideways, at the rear.

Figure 4:
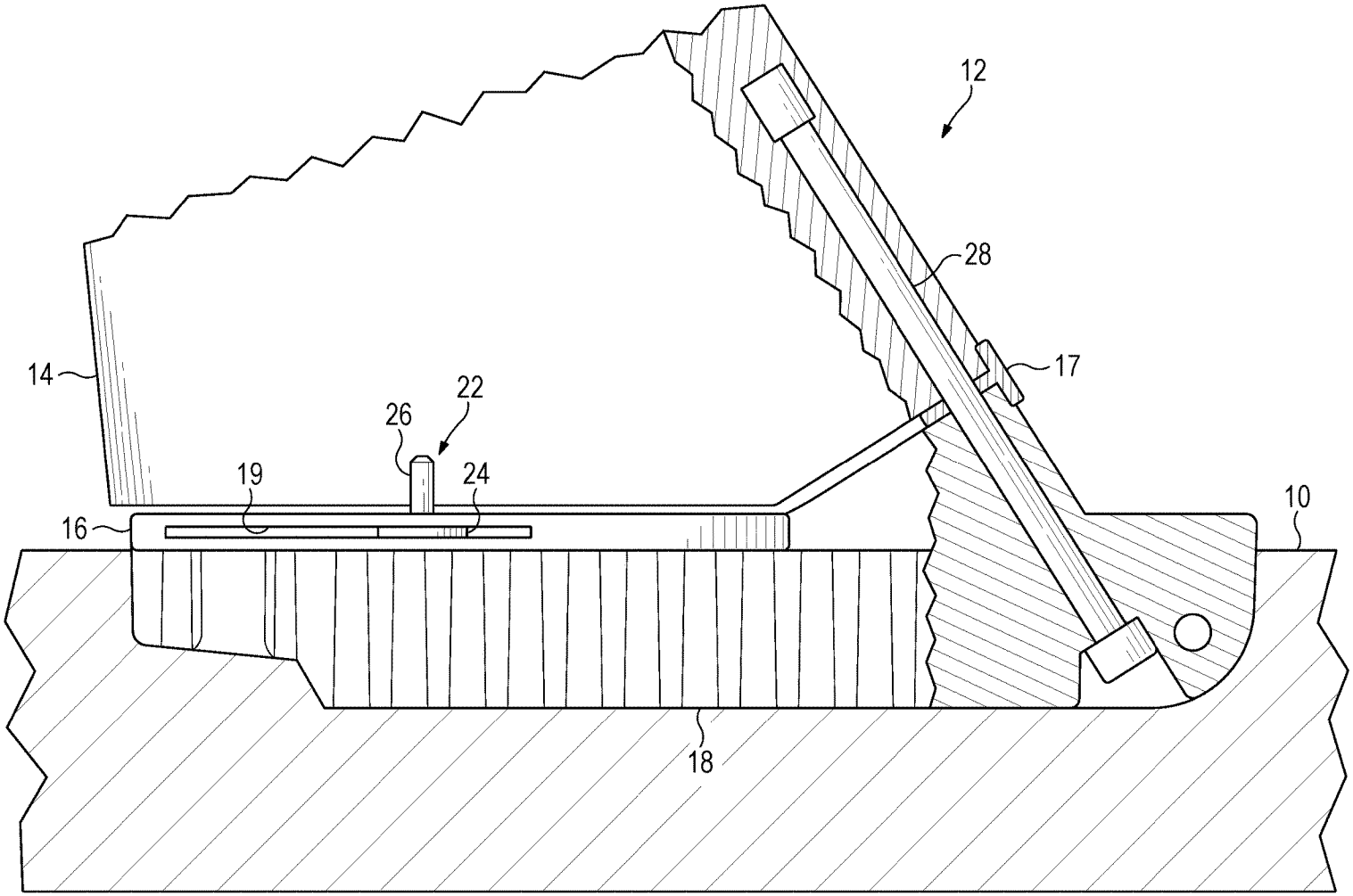
FIG. 4 is a detail sectional view of the surfboard of FIG. 1 showing the fin assembly secured to the surfboard via mating of the blade with the finbox.

Referring now to FIG. 4, in one embodiment the fin assembly 12 comprises a fin 14, a base 16, and a blade 18. A surfboard 10 is provided, having a standard finbox. The standard finbox comprises a recess in the body of the surfboard having means for attaching a surfboard fin having an appropriate connector. The blade 18 mates with the standard finbox to connect the fin assembly 12 to the surfboard 10. When connected to the surfboard, the greatest length of the blade 18 is substantially parallel to the longitudinal axis of the surfboard. A rod 28 extends from the blade and is connected to the fin 14. In one embodiment, the rod 28 is tilted toward the back of the surfboard. The attack angle of a surfboard fin is the angle of the plane of the fin relative to the longitudinal axis of the surfboard. The fin 14 rotates with respect to the blade 18, allowing the attack angle of the fin to vary. The fin centering element 17, which is elastomeric, urges fin 14 back to the center position. In one embodiment, fin 14 rotates with respect to the rod 28. In an alternative embodiment, the rod 28 rotates with respect to the blade 18. The fin-stop post 26 protrudes into the path of rotation of the fin 14, preventing the fin from rotating past the location of the fin-stop post.

Figure 5:
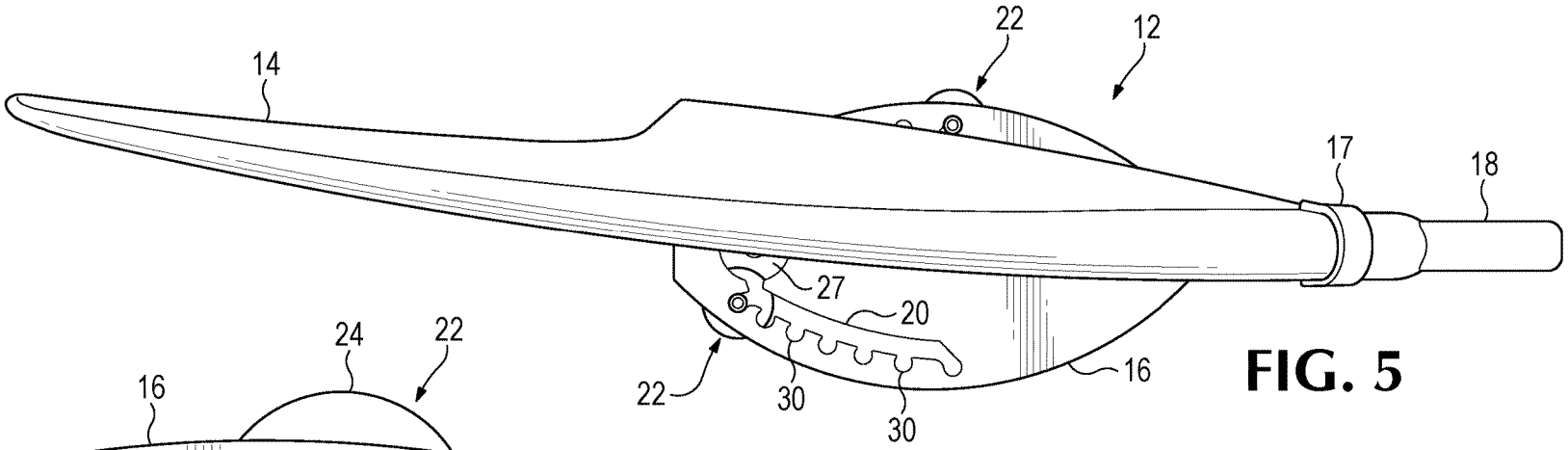
FIG. 5 is a bottom view of the fin assembly of FIG. 1, showing a fin-stop pin engaged in the last pin-fixation position and the corresponding maximum rotation of the fin, as it abuts that fin-stop pin.
Figure 6:
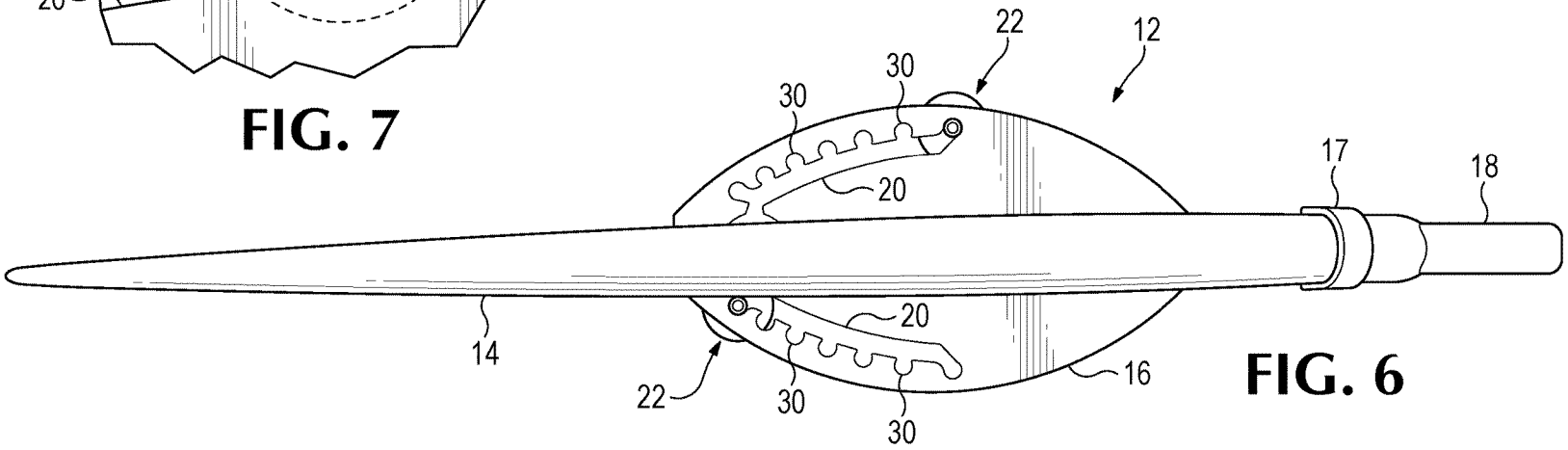
FIG. 6 is a bottom view of the fin assembly according of FIG. 1, showing a fin-stop pin engaged in the first pin-fixation position and the corresponding maximum rotation of the fin, as it abuts that fin-stop pin.

Referring now to FIGS. 5 and 6, in one embodiment, the base 16 comprises two pin guideways 20, one on each side of the fin 14. Along each pin guideway 20 are two or more pin-fixation positions 30. In one embodiment, each pin-fixation position is a notch of sufficient width to admit the fin-stop post 26 (FIGS. 2-4 and 7). In one embodiment, each pin-fixation position 30 includes means to retain the fin-stop post 26, allowing the post to pass through only with the application of pressure. One means of retention is a narrowing at the entrance of the pin-fixation position 30. As the fin-stop pin 22 is moved into a pin-fixation position 30, the post 26 must pass through the narrower area. The narrowing is sized to allow the post 26 to pass through with the application of manual pressure but to prevent the post from passing through due to pressure caused by normal use of the fin assembly 12. Each pin guideway 20 contains a fin-stop pin 22, allowing the maximum rotation of the fin 14 in the clockwise and counter-clockwise directions to be independently controlled. FIG. 5 shows one fin-stop pin 22 in the last pin-fixation position 30 and the fin 14 at the maximum clockwise rotation permitted by that pin-fixation position. FIG. 6 shows one fin-stop pin 22 in the first pin-fixation position and the fin 14 at the maximum counter-clockwise rotation permitted by that pin-fixation position. It will be understood from FIGS. 5 and 6 that each fin-stop pin 22 can be located at any pin-fixation position 30 along the pin guideway 20, allowing the surfer to choose the appropriate pin-fixation position for the maximum amount of rotation desired.

In one embodiment, the entire assembly 10 (except for rod 28) is molded from ABS, a similar polymeric material or a type of fiberglass. In another embodiment, base 16 is made of a metal, such as a cast aluminum alloy or titanium, with the remainder, such as the fin 14 made of ABS, a similar polymer or fiberglass.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A surfboard fin assembly having a front and a back, a top and a bottom, and comprising:

(a) a standard finbox-engaging blade, having a bottom, and defining a blade plane along its greatest extent;

(b) a base, substantially perpendicular and rigidly attached to said blade at said bottom, defining a base plane along its greatest extent and having two pin guideways, a said pin guideway being defined on either side of said blade plane; and (c) a rod attached to and extending down from said blade;

(d) a fin, connected to and extending rearwardly from said rod so that it can rotate about said rod, through said blade plane; and (e) two fin-stop pins, each one adapted to be placed in one of said pin guideways, to project out of said guideway into a path of rotation of said fin, to block said fin from moving beyond an adjustable range of rotation set by said fin-stop pin positions.

2. The surfboard fin assembly of claim 1, further includes an elastomeric fin centering element, positioned about a front, bottom portion of said fin and urging said fin to a centered position.

3. The surfboard fin assembly of claim 1, wherein said rod is rotatably connected to said blade.

4. The surfboard fin assembly of claim 1, wherein said fin is rotatably connected to said rod.

5. The surfboard fin assembly of claim 1, wherein said base has a bottom surface and defines a void space for each pin guideway, and wherein each said pin guideway is a channel formed from said bottom surface to said void space.

6. The surfboard fin assembly of claim 5, wherein said channels define a set of pin-fixation positions along their lengths, where a said fin-stop pin can be fixed in position.

7. The surfboard fin assembly of claim 5, wherein said pins each have a wide base that fits into said void space, but cannot pass through said channel, and a post that does extend through said channel, to extend into a path of rotation of said fin.

8. The surfboard fin assembly of claim 7, wherein said base has a pair of side surfaces, and wherein said void space for each guide path is formed by a cut parallel to said base plane, formed into a side surface of said base and extending inwardly, past said channel.

9. The surfboard fin assembly of claim 6, further including at least one fin-stop pin port, comprising a through-hole from said bottom surface of said base to said void space, large enough so that a fin-stop pin base can fit through it, and contiguous to a said channel, so that a fin-stop pin base can be introduced into said void space through through-hole and said fin-stop pin can then be moved so that said post is moved into said channel and said base is retained in said void space.

10. A surfboard having a top and a bottom, comprising:

(a) a board portion having a bottom and defining a board plane, bisecting said board between top and bottom along its dimension of greatest extent, and a fin plane, bisecting said board along its length and being perpendicular to said board plane;

(b) a fin assembly, attached to said board portion, and including:

(i) a base, attached to said bottom of said board and extending in a plane substantially parallel to said board plane, said base further having two pin guideways, a said pin guideway being defined on either side of said fin plane;

(ii) a rod attached to and extending down from said base;

(iii) a fin, connected to and extending rearwardly from said rod so that it can rotate about said rod, through said fin plane; and (c) a fin-stop pin in each pin guideway, projecting out of said guideway into a path of rotation of said fin, to block said fin from moving beyond an adjustable range of rotation set by said fin-stop pin positions.

11. The surfboard of claim 10, wherein said board portion defines a fin port and wherein said fin assembly further includes a mating portion, which is releasably mated into said fin port.

12. The surfboard of claim 10, wherein said fin port is a standard fin box and said mating portion is a blade.

13. The surfboard of claim 10, wherein said fin-stop pins are independently adjustable to allow rotation of said fin relative to said fin plane, up to 22.5 degrees.

14. The surfboard of claim 10, wherein said rod is tilted rearwardly, relative to a line perpendicular to said board plane.

15. A surfboard fin assembly having a front and a back, a top and a bottom, and comprising:

(a) a standard finbox-engaging blade, having a bottom, and defining a blade plane along its greatest extent;

(b) a base, substantially perpendicular and rigidly attached to said blade at said bottom, defining a base plane along its greatest extent and defining a set of fin-stop pin holders;

(c) a rod attached to and extending down from said blade;

(d) a fin, connected to and extending rearwardly from said rod so that it can rotate about said rod, through said blade plane; and (e) two fin-stop pins, each one adapted to be placed in one of said fin-stop pin holders, to project out of said fin-stop pin positions into a path of rotation of said fin, to block said fin from moving beyond an adjustable range of rotation set by said fin-stop pin positions.

16. The surfboard fin assembly of claim 15, wherein at least some of said fin-stop pin holders are connected together by fin-stop pin guideways, through which a fin stop pin can move.

17. The surfboard fin assembly of claim 16, further including a fin-stop pin port, into which a fin-stop pin may be introduced into a guideway.

18. The surfboard fin assembly of claim 15, wherein said base has a bottom surface and defines a void space for each fin-stop pin holder, and wherein each said pin holder includes an opening formed from said bottom surface to said void space, and wherein said opening includes a narrow portion.

19. The surfboard fin assembly of claim 18, wherein said pins each have a wide base that fits into said void space, but cannot pass through said narrow portion of said opening, and a post that does extend through said narrow portion of said opening, to extend into a path of rotation of said fin.

20. The surfboard fin assembly of claim 19, further including at least one fin-stop pin port, comprising a through-hole from said bottom surface of said base to said void space, large enough so that a fin-stop pin base can fit through it, and contiguous to a narrow portion, so that a fin-stop pin base can be introduced into said void space through through-hole and said fin-stop pin can then be moved so that said post is moved into said narrow portion and said base is retained in said void space.

21. The surfboard fin assembly of claim 18, wherein said base has a pair of side surfaces, and wherein said void space for each guide path is formed by a cut parallel to said base plane, formed into a side surface of said base and extending inwardly, past said channel.

* * * * *